US007322334B1

(12) United States Patent
O'Brien

(10) Patent No.: US 7,322,334 B1
(45) Date of Patent: Jan. 29, 2008

(54) APPARATUS AND METHOD FOR STARTING A CHAIN SAW

(76) Inventor: John T. O'Brien, 6141 County Rd. A, Webster, WI (US) 54893

( * ) Notice: Subject to any disclaimer, the term of this patent is extended or adjusted under 35 U.S.C. 154(b) by 159 days.

(21) Appl. No.: 11/364,674

(22) Filed: Feb. 28, 2006

(51) Int. Cl.
*F02N 3/04* (2006.01)

(52) U.S. Cl. ..... 123/185.4

(58) Field of Classification Search ..... 123/185.1, 123/185.2, 185.3, 185.4, 185.5; 74/6
See application file for complete search history.

(56) References Cited

U.S. PATENT DOCUMENTS 3,018,768 A * 1/1962 Thompson ..... 123/185.4
4,397,274 A * 8/1983 Tarnedde ..... 123/185.4
5,070,828 A * 12/1991 Chestnutt ..... 123/185.4
6,497,210 B1 * 12/2002 Kattenhorn ..... 123/185.4

* cited by examiner

*Primary Examiner*—Stephen K. Cronin
*Assistant Examiner*—Arnold Castro
(74) *Attorney, Agent, or Firm*—Elizabeth D. Lewen; Sharrill Law Offices, PLLC

(57) ABSTRACT

A chainsaw starting apparatus comprises a frame, a first crank arm, a second crank arm, and a locking mechanism. The frame is designed to occupy a fixed position relative to a floor surface. The first crank arm and the second crank arm are each rotationally supported by the frame and interconnected to produce rotational movement of one arm upon rotational movement of the other arm. The locking mechanism may be used for releasably attaching a chainsaw to the frame.

11 Claims, 4 Drawing Sheets

APPARATUS AND METHOD FOR STARTING A CHAIN SAW

FIELD OF INVENTION

The invention relates to an apparatus and method of starting a chainsaw with a pull cord activated starter.

BACKGROUND

Many households as well as business have one or more chainsaws to help in cutting brush and trees. Most chainsaws are started by pulling a pull cord. The coordination and upper body strength needed to pull the starter pull cord properly to start the chainsaw can be considerable. Many people lack the upper body strength or have a disability that makes pulling the starter pull cord so as to start the chainsaw, difficult or impossible.

Individuals that have trouble starting a starter pull cord chainsaw may use an electric chainsaw. Electric chainsaws do not require a starter pull cord to start. But, electric chainsaws are limited to use near a power outlet and typically are only for use with smaller diameter trees and brush.

Therefore, a need exists for an apparatus to assist in starting a starter pull cord chainsaw that requires less upper body strength and coordination by the user.

SUMMARY OF THE INVENTION

A first embodiment of the invention is a chainsaw starting apparatus comprising a frame, a first crank arm, a second crank arm, and a locking mechanism. The frame is designed to occupy a fixed position relative to a floor surface. The first crank arm and the second crank arm are each rotationally supported by the frame and interconnected to produce rotational movement of one arm upon rotational movement of the other arm. The locking mechanism may be used for releasably attaching a chainsaw to the frame.

A second embodiment of the invention is a chainsaw starting apparatus comprising a frame, a first crank arm, a second crank arm, and a lever-actuated pivoting catch. The frame is designed to occupy a fixed position relative to a floor surface. The first crank arm and the second crank arm are each rotationally supported by the frame and interconnected by a common drive shaft to produce rotational movement of one arm upon rotational movement of the other arm. The lever-actuated pivoting catch may be used for releasably attaching a chainsaw to the frame.

A third embodiment of the invention for starting a chainsaw involves locking a chainsaw having a starter pull cord with a start handle onto a frame. The starter handle is engaged with a second crank arm that is supported by the frame. A first crank arm offset from and interconnected to the second crank arm is rotated. The rotation of the first crank arm produces rotation of the second crank arm and thereby pulls the starter pull cord so as to start the chainsaw.

DETAILED DESCRIPTION OF A PREFERRED EMBODIMENT

Definitions

As utilized herein, including the claims, the phrase "motion transference system," means a system to transfer the movement of one crank arm by rotary motion to a second crank arm using well known rotary motion transfer systems such as a drive shaft system, chain and sprocket system, a belt and pulley system, and a gearing system.

Nomenclature

Figure 1:
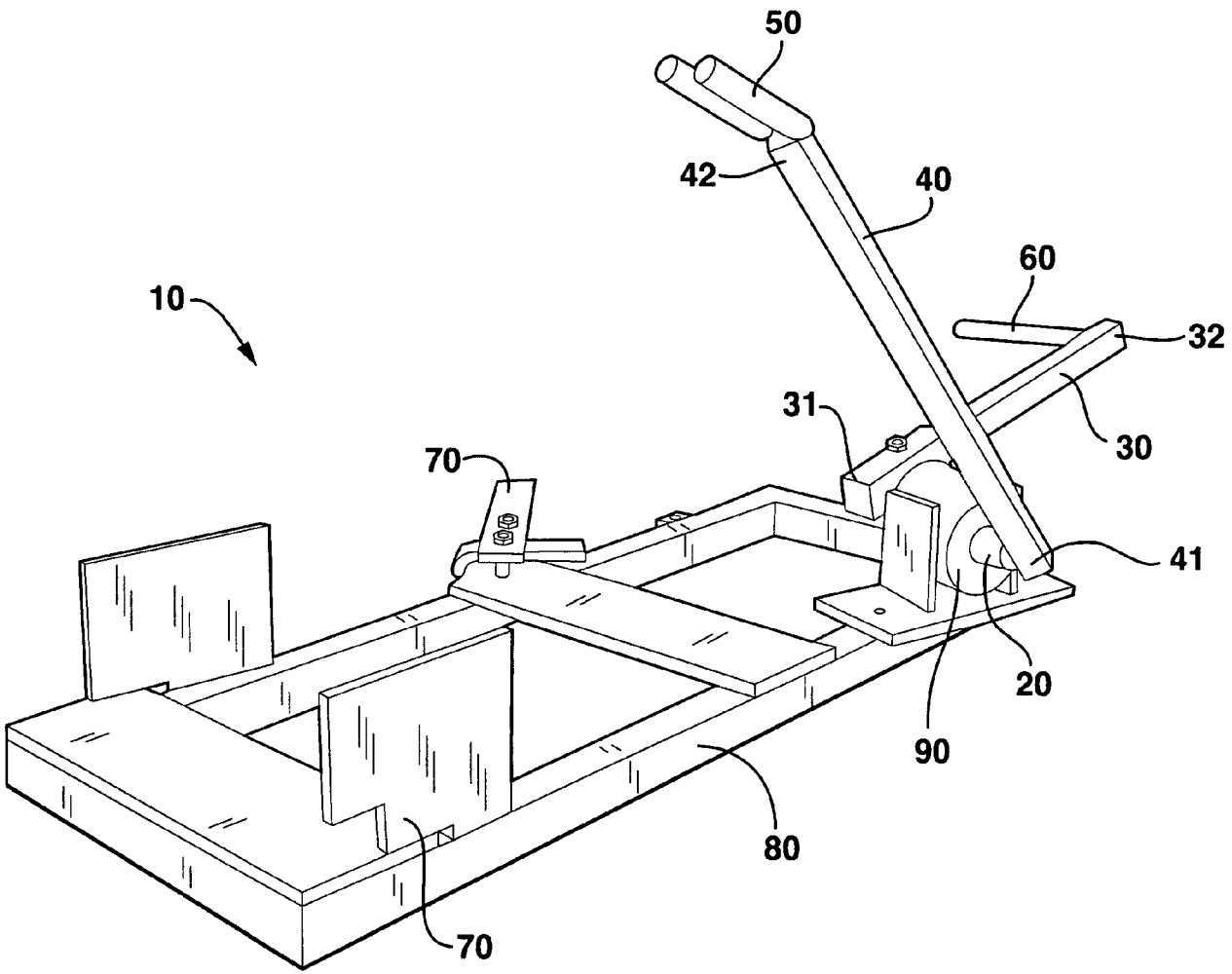
FIG. 1 is a front perspective view of one embodiment of the chainsaw starting apparatus.
Figure 2:
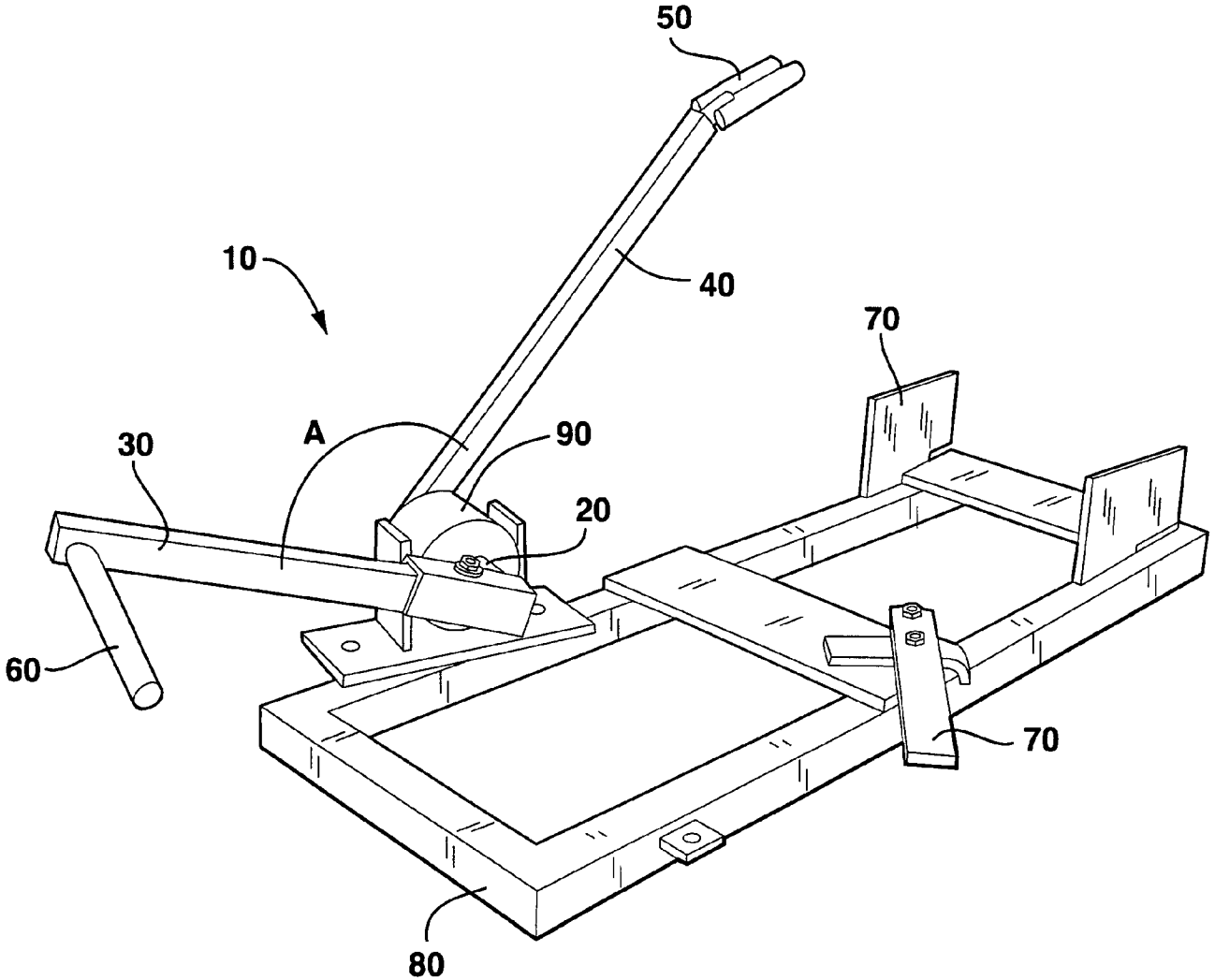
FIG. 2 is a rear side perspective view of the apparatus in FIG. 1.

10 Apparatus
20 Drive shaft
30 First crank arm
31 First end of first crank arm
32 Second end of first crank arm
40 Second crank arm
41 First end of second crank arm
42 Second end of second crank arm
50 Hook
60 Foot pedal
70 Locking mechanism
80 Frame
90 Bearing
100 Chainsaw
101 Starter pull cord
102 Starter handle
103 Rear handle
104 Forward handle
200 Floor Surface
A Angle Construction The apparatus 10 can be used to assist in starting chainsaw 100 with a starter pull cord 101. As shown in FIGS. 1 and 2, one embodiment of the apparatus 10 comprises a frame 80, a first crank arm 30, a second crank arm 40, and a locking mechanism 70. The frame 80 is designed to occupy a fixed position relative to a floor surface 200. The frame 80 may be made from any number of suitable materials including metal, wood, and plastic. The preferred material is metal.

As shown in FIGS. 1-4, the frame 80 supports a first crank arm 30 and a second crank arm 40. The frame 80 may be configured and arranged to allow the rotational movement of the attached first crank arm 30 and second crank arm 40. The first crank arm 30 and the second crank arm 40 may be interconnected to produce rotational movement of one arm upon rotational movement of the other arm. The rotational movement may be accomplished by any known motion transference system, including a chain and sprocket system, a belt and pulley system, and a gearing system with a preference for a common drive shaft 20 and bearing 90 system.

As shown in FIGS. 1 and 2, in the preferred common drive shaft 20 and bearing 90 system the first crank arm 30 and the second crack arm 40 are interconnected by attachment to opposite ends (not numbered) of a common drive shaft 20 rotationally engaged with a bearing 90. The bearing 90 is then attached to the frame 80. The first end 31 of the first crank arm 30 may be attached to one end (not numbered) of the common drive shaft 20. The first end 41 of the second crank arm 40 may be attached to the opposite end (not numbered) of the common drive shaft 20. The first crank arm 30 and the second crank arm 40 extend from the common drive shaft 20 at an angle A of between about 90° and 150° relative to one another. The preferred angle A is about 110°.

In another embodiment of the invention, the first crank arm 30 and the second crank arm 40 may each be attached to separate drive shafts 20. The two drive shafts 20 may then be interconnected by a gearing system, a chain and sprocket system, or a belt and pulley system to provide rotational movement of one crank arm by rotational movement of the other crank arm. These systems are well known motion transference systems just as the common drive shaft 20 and bearing 90 system.

The apparatus 10 may also include a locking mechanism 70 for releasably attaching a chainsaw 100 to the frame 80. The locking mechanism 70 may be any known locking mechanism 70, including a clamp. hasp, latch, extendable elastic cord, rubber strap, tie down, ratchet strap, nylon strap, rope, cloth strap, plastic strap, cable ties, lashing ties, hook and loop tape, catch, and hook. As shown in FIGS. 1 and 2, the preferred locking mechanism 70 is a lever-actuated pivoting catch. The locking mechanism 70 may be placed anywhere on the frame 80 that allows attachment of the chainsaw 100 to the frame 80 so as to prevent the chainsaw 100 from detaching from the frame 80 during use of the apparatus 10. As shown in FIGS. 1 and 2, the preferred placement of the locking mechanism 70 on the frame 80 is in an area that allows the locking mechanism 70 to engage the rear handle 103 of the chainsaw 100 when the chainsaw 100 is attached to the frame 80.

Figure 3:
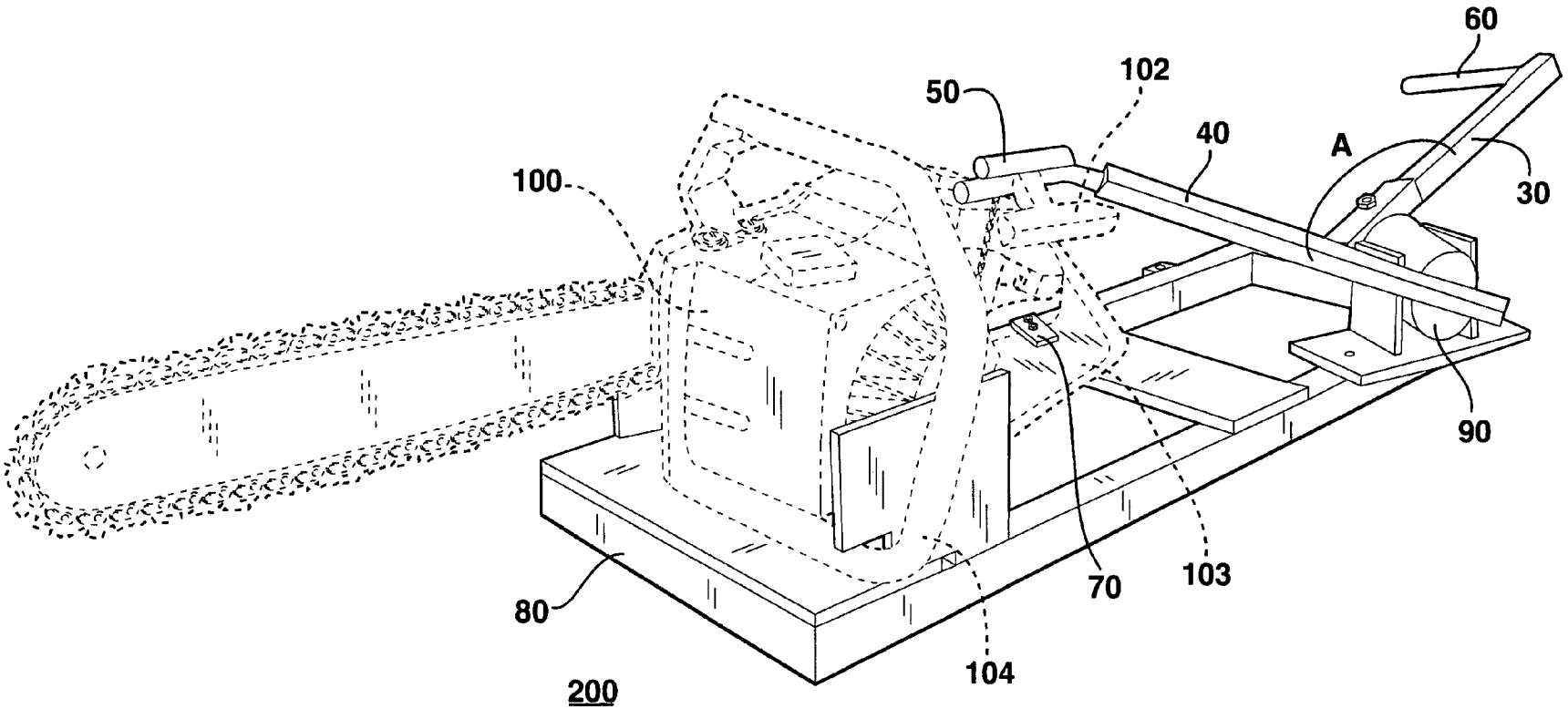
FIG. 3 is a front side perspective view of the apparatus in FIG. 1 with a chainsaw placed on the frame.

The apparatus 10 may include more than one locking mechanism 70 to increase the stability of the apparatus 10 and the chainsaw 100 during use of the apparatus 10. As shown in FIG. 3, one embodiment of the apparatus 10 may include a stationary catch locking mechanism 70 that releasably attaches the front handle 104 of a chainsaw 100 to the frame 80.

The apparatus 10 may further include a hook 50 configured and arranged to cooperatively engage a starter handle 102 on a chainsaw 100 attached to the frame 80. The hook 50 cooperatively engages the starter handle 102 by grasping the starter handle 102 so as to allow the hook 50 to pull the starter handle 102 and the attached starter pull cord 101 out of the chainsaw 100 housing (not numbered) to start the chainsaw 100. As shown in FIG. 1, the hook 50 may be fixedly or removably attached proximate the second end 42 of the second crank arm 40.

The apparatus 10 may also include a foot pedal 60 to facilitate easier use of the first crank arm 30. As shown in FIG. 2, the foot pedal 60 may by attached proximate the second end 32 of the first crank arm 30.

Use

The chainsaw 100 starting apparatus 10 can be used to start a chainsaw 100 with a starter pull cord 101 without the use of a person's hands (not shown). The frame 80 is designed to occupy a fixed position relative to the floor surface 200. A chainsaw 100 may be placed upon the frame 80. The locking mechanism 70 may then be used to lock the chainsaw 100 onto the apparatus 10. As shown in FIG. 3, the apparatus 10 may have more than one locking mechanism 70. Preferably a locking mechanism 70 is used on the rear handle 103 and the forward handle 104 to secure the chainsaw 100 during use of the apparatus 10. Once the chainsaw 100 is locked onto the apparatus 10 the second crank arm 40 may be attached to the starter handle 102.

Figure 4:
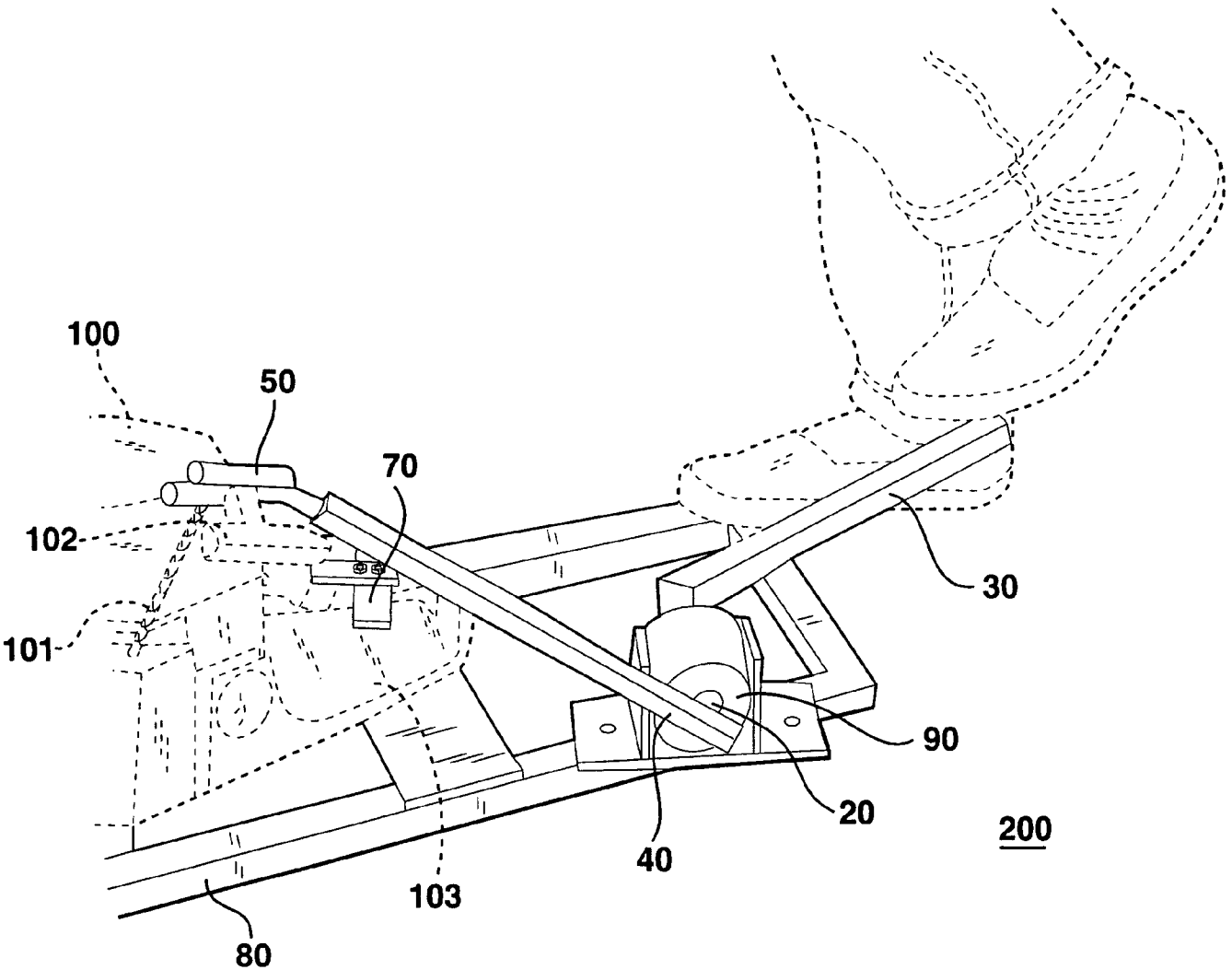
FIG. 4 is a partial rear side perspective view of the apparatus in FIG. 3 wherein the first crank arm is rotating so as to pull the starter pull cord on the chainsaw.

A hook 50 may be attached proximate the second end 42 of the second crank arm 40 and configured and arranged to cooperatively engage the starter handle 102 on the chainsaw 100. Once the starter handle 102 is securely attached to the second crank arm 40 the first crank arm 30 may be rotated to produce rotation of the second crank arm 40. As shown in FIG. 4, the rotation of the first crank arm 30 may be accomplished by the user (not numbered) placing a foot or hand upon the first crank arm 30 and applying force to the first crank arm 30 to rotate the first crank arm 30 toward the floor surface 200 upon which the frame 80 is placed. A foot pedal 60 may be attached proximate the second end 32 of the first crank arm 30 to provide a larger area for placing the hand or foot. Rotation of the second crank arm 40 pulls the starter handle 102 which pulls the starter pull cord 101 so as to start the chainsaw 100.

If the chainsaw 100 does not start after the first rotation of the second crank arm 40, then the first crank arm 30 may be allowed to rotate back to its starting position. The first crank arm 30 may then be rotated once again to produce rotation of the second crank arm 40 and pulling of the starter handle 102 a second time. Rotation of the first crank arm 30 and second crank arm 40 may be repeated as often as necessary until the chainsaw 100 starts.

Once the chainsaw 100 starts, the first crank arm 30 may be allowed to return to its starting position. The second crank arm 40 may then be disengaged from the starter handle 102. The locking mechanisms 70 may them be unlocked and the chainsaw 100 removed from the frame 80 for use.

I claim:

1. A chainsaw starting apparatus comprising:

(a) a frame designed to occupy a fixed position relative to a floor surface;

(b) a first crank arm and a second crank arm each rotationally supported by the frame and interconnected to produce rotational movement of one arm upon rotational movement of the other arm; and (c) a locking mechanism for releasably attaching a chainsaw to the frame.

2. The chainsaw starting apparatus, as recited in claim 1, further comprising a hook attached proximate a second end of the second crank arm and configured and arranged to cooperatively engage a starter handle on a chainsaw attached to the frame by the locking mechanism.

3. The chainsaw starting apparatus, as recited in claim 1, further comprising a foot pedal attached proximate a first end of the first crank arm.

4. The chainsaw starting apparatus, as recited in claim 1, wherein the locking mechanism is a lever-actuated pivoting catch.

5. The chainsaw starting apparatus, as recited in claim 1, wherein the first crank arm and second crank arm are attached to opposite ends of a common drive shaft.

6. The chainsaw starting apparatus, as recited in claim 1, wherein (i) the first crank arm is attached to a first drive shaft and the second crank arm is attached to a second drive shaft, and (ii) the first drive shaft and the second drive shaft are interconnected by a motion transference system.

7. The chainsaw starting apparatus, as recited in claim 6, wherein the motion transference system is a chain and sprocket system.

8. The chainsaw starting apparatus, as recited in claim 6, wherein the motion transference system is a belt and pulley system.

9. The chainsaw starting apparatus, as recited in claim 6, wherein the motion transference system is a gearing system.

10. A chainsaw starting apparatus comprising:

(a) a frame designed to occupy a fixed position relative to a floor surface;

(b) a first crank arm and a second crank arm each rotationally supported by the frame and interconnected by a common drive shaft to produce rotational movement of one arm upon rotational movement of the other arm; and (c) a lever-actuated pivoting catch for releasably attaching a chainsaw to the frame.

11. A method for starting a chainsaw comprising the steps of:

(a) locking a chainsaw having a starter pull cord with a starter handle onto a frame;

(b) engaging the starter handle with a second crank arm supported by the frame; and (c) rotating a first crank arm offset from and interconnected to the second crank arm whereby rotation of the first crank arm produces rotation of the second crank arm and thereby pulls the starter pull cord so as to start the chainsaw.

* * * * *